United States Patent [19]

Nuver

[11] 4,197,485

[45] Apr. 8, 1980

[54] OPTOCOUPLER DIMMER CIRCUIT FOR HIGH INTENSITY, GASEOUS DISCHARGE LAMP

[75] Inventor: Eric L. H. Nuver, San Marcos, Tex.

[73] Assignee: Esquire, Inc., New York, N.Y.

[21] Appl. No.: 927,555

[22] Filed: Jul. 24, 1978

[51] Int. Cl.[2] ..... H05B 41/392; H05B 41/16

[52] U.S. Cl. ..... 315/291; 250/551; 315/158; 315/284; 315/311; 315/DIG. 4

[58] Field of Search ..... 315/156, 158, 159, 194, 315/284, 291, 307, 311, DIG. 4; 250/551

[56] References Cited

U.S. PATENT DOCUMENTS

| | | | |
|---|---|---|---|
| 3,459,943 | 8/1969 | Harnden, Jr. | 315/156 X |
| 3,466,500 | 9/1969 | Peek | 315/DIG. 5 |
| 3,816,794 | 6/1974 | Snyder | 315/194 |
| 3,845,350 | 10/1974 | Luursema et al. | 315/307 X |
| 3,894,265 | 7/1975 | Holmes et al. | 315/283 X |
| 4,016,451 | 4/1977 | Engel | 315/158 |

*Primary Examiner*—Eugene R. LaRoche

*Attorney, Agent, or Firm*—Frank S. Vaden, III

[57] ABSTRACT

A dimmer circuit for a high intensity, gaseous discharge lamp having a ballast with a reactive portion, the current bypass or partial bypass of which determines the brightness of the lamp, the bypass being controlled by gated bypass means, preferably in the form of a triac, driven by the photodrive element of an optocoupler, the light emitting diode element of the optocoupler receiving pulses and actuating the photodrive element for passing a gate trigger signal to the gated bypass means.

34 Claims, 17 Drawing Figures

FIG. 2
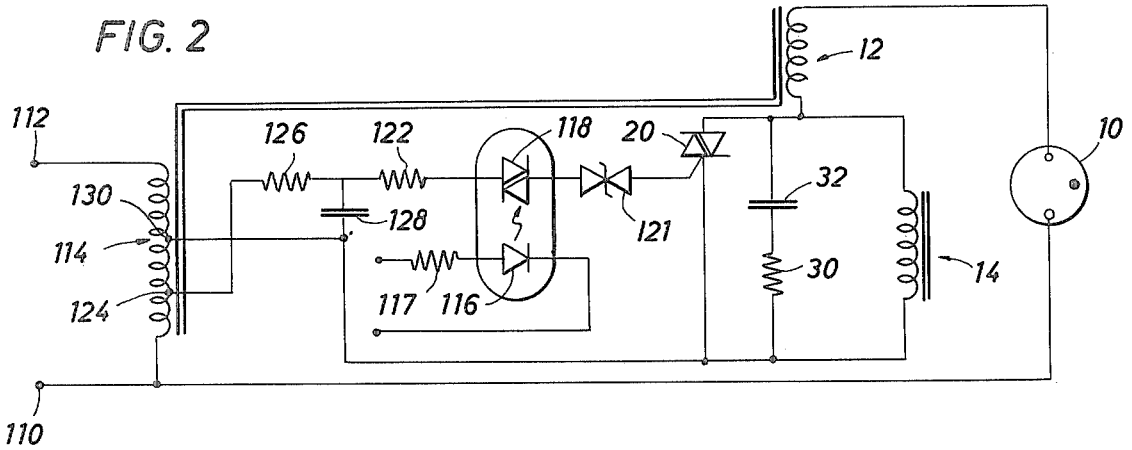
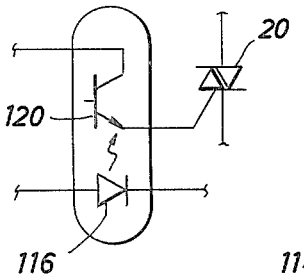
FIG. 3
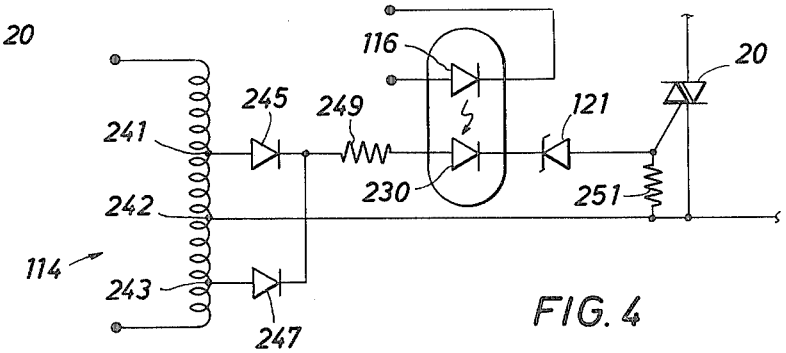
FIG. 4
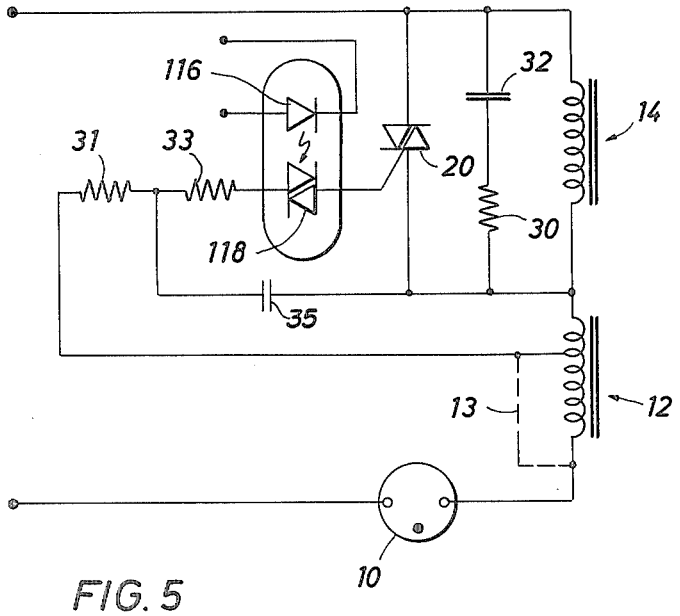
FIG. 5
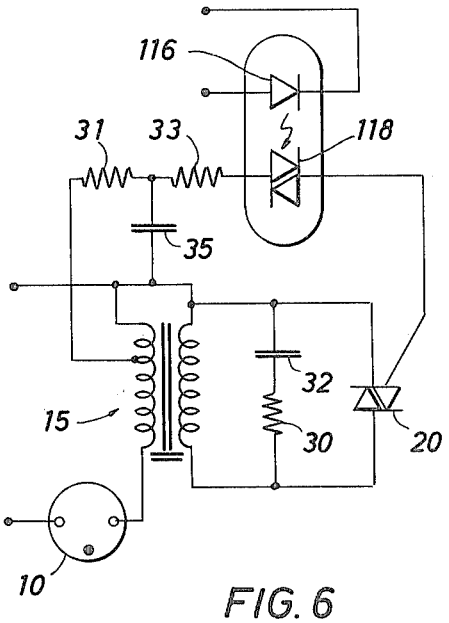
FIG. 6

OPTOCOUPLER DIMMER CIRCUIT FOR HIGH INTENSITY, GASEOUS DISCHARGE LAMP

BACKGROUND OF THE INVENTION

1. Field of the Invention

This invention relates to dimmer circuits for high intensity, gaseous discharge (HID) lamps and more particularly to such a dimmer that provides dimming current to the lamp through at least partial ballast reactive bypass.

2. Description of the Prior Art

U.S. Pat. No. 3,816,794, Snyder, describes a circuit employing a two-part reactive ballast connected in series with a high intensity, gaseous discharge lamp. One of the two elements of the ballast is connected across the main terminals of a triac operating as a gated bypass means. When the triac conducts a current path is established through the triac, at least partially bypassing the reactive element. The duration of conduction determines the total amount of current through the ballast, and hence through the lamp, thereby providing a means for establishing the brightness of the lamp.

In the circuit described in U.S. Pat. No. 3,816,794, low gate source or drive voltage to the gate of the gates bypass triac is derived from a potentiometer, an isolating transformer circuit, a second triac and a Zener diode network, together with other components. The gated bypass triac is fired from a gate source voltage in phase with line voltage, the amplitude being controlled by a gate-signal control device including a Zener diode to properly time the turning on of the triac in relation to lamp current. The Zener diode also prevents the triac from remaining conductive past a time when there might be opposite polarity ballast-element voltage and lamp current, which would cause flicker of the lamp. Connection to multiple lamp circuits and to three phase systems was cumbersome, and isolation of the triggering of the gated bypass triac and the power for the circuit was incomplete.

U.S. Pat. No. 3,894,265 discloses a circuit that provides a control network for the gated bypass network including the programmable unijunction transistor. Ready connection to single power and three phase power systems is achieved, but the gating of the bypass triac is still not independent of the ac distribution voltage.

It is therefore a feature of the present invention to provide an improved dimmer circuit having a bypass triac or other gated means for at least partially bypassing a reactive ballast element connected to an HID lamp, the voltage source for driving the gated bypass means and the activation of such source being isolated.

It is another feature of the present invention to provide an improved dimmer circuit having a gated bypass means for at least partially bypassing a reactive ballast element connected to an HID lamp, the voltage source for driving the gated bypass means and the activation of such source being isolated by way of an optically isolated driver means, such as an optocoupler.

It is still another feature of the present invention to provide an improved dimmer circuit having a gated bypass means for at least partially bypassing a reactive ballast element connected to an HID lamp, the voltage source for driving the gated bypass means being through the operation of the driver portion of an optocoupler connected to the gated bypass means, a pulse activated receiver portion activating the driver portion.

It is yet another feature of the present invention to provide an improved dimmer circuit having a gated bypass means, a pulse activated receiver portion activating the driver portion, the pulse actuation being derived from high frequency bursts superimposed on the ac distribution line to the circuit.

SUMMARY OF THE INVENTION

The present invention employs an optically isolated driver means, preferably in the form of an optocoupler, for providing separated timing and trigger actuation functions to a gated bypass means connected to a reactive portion of a lamp ballast. The gated bypass means and ballast connections are similar to that shown in the circuits disclosed in U.S. Pat. Nos. 3,816,794 and 3,894,265; however, in the present invention, the gate of the gated bypass means, normally a triac, is connected to the drive element, such as a phototriac, phototransistor, or photoSCR, or an optocoupler. The receiver element, preferably in the form of a light emitting diode (LED), is actuated by externally applied pulses. The pulsing determines the duration of conduction of the LED and, hence, the duration of drive voltage through the driver portion to the gated bypass means.

The low voltage applied through the driver portion is derived from the ac distribution line by transformer action, a capacitor divider network, a tap from a reactor ballast, or the like. Bridge networks and Zener diodes can be used to ensure operation of the gated bypass means only at proper operating times.

The LED can be connected to receive unipolar pulses, or can be connected to a suitable rectifier network for pulse shaping from bipolar pulses to unipolar pulses. Also, high frequency signals superimposed over the ac distribution line or applied by separate gate leads can be suitably filtered for use as pulses applied to the LED. The use of high frequency in this connection also permits selective filtering from among different frequencies by timed circuits connected to different lamps so that selective dimming of the different lamps may be chosen.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is noted, however, that the appended drawings illustrate only typical embodiments of the invention and are therefore not to be considered limiting of its scope, for the invention may admit to other equally effective embodiments.

In the drawings:

FIG. 2 is a schematic diagram of a preferred embodiment of the present invention.

FIG. 3 is a partial schematic of an alternate form of optocoupler that can be used in the embodiments of the present invention.

FIG. 4 is a partial schematic diagram of an alternate form of optocoupler employing a photo-SCR that can be used in the embodiments of the present invention.

FIG. 5 is a schematic diagram of an embodiment of the present invention employing a low voltage tap on a reactor ballast for supplying low voltage to the driver portion of an optocoupler.

FIG. 6 is a schematic diagram of an embodiment of the present invention employing a loosely coupled reactive ballast transformer, a low voltage tap on the primary winding thereof supplying low voltage to the driver portion of an optocoupler.

DESCRIPTION OF PREFERRED EMBODIMENT

The invention described herein is an improvement of the dimming circuit described in U.S. Pat. No. 3,894,265, commonly assigned, and which is incorporated herein by reference for all purposes.

Figure 1:
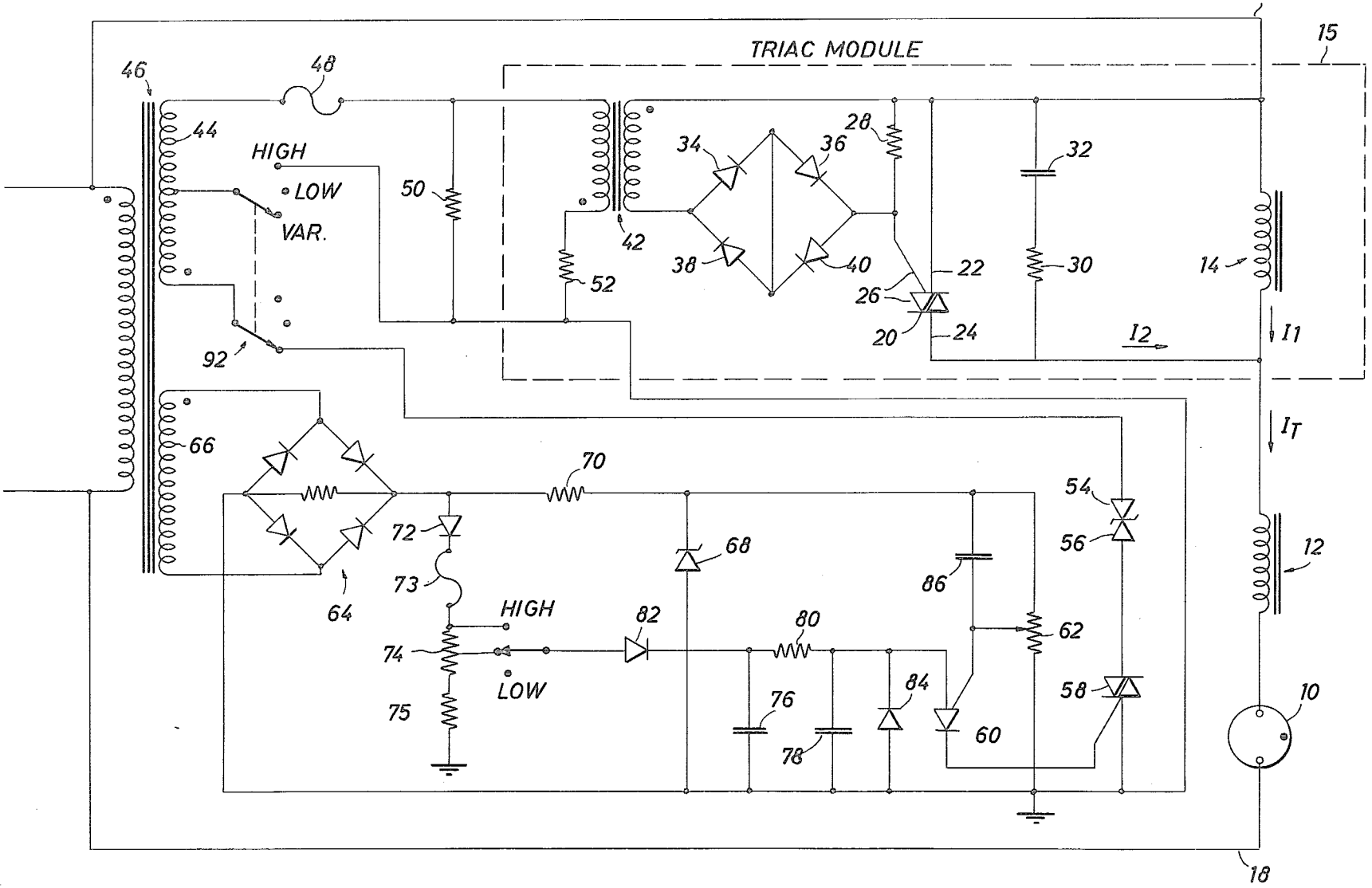
FIG. 1 (PRIOR ART)
FIG. 1 is a schematic diagram of a prior art dimming circuit. The embodiments of the present invention are substantially comparable thereto in operation with the exception of the triac module.

Now referring to the drawings and first to FIG. 1, which is also FIG. 1 of U.S. Pat. No. 3,894,265, high intensity, discharge lamp 10 is connected in series with two inductive ballast elements 12 and 14, the entire combination being connected between lines 16 and 18. Gated bypass means in the form of triac 20 is connected across element 14, first main terminal 22 of the triac being connected to line 16 and second main terminal 24 being connected to a junction between the two elements. Gate terminal 26 is connected to shunt resistor 28, which is also connected to line 16. Resistor 30 and capacitor 32, connected in series with each other and in parallel with element 14, are provided as a snubber device to provide triac 20 immunity from commutating dv/dt false turn on. Two pairs of diodes 34 and 36 and 38 and 40 connected to gate 26 provide the gate source voltage to triac 20 from transformer 42. These diodes are connected so that two diodes 34 and 36 face forward and two diodes 38 and 40 face backwards, with the junction point between each pair being connected together. Diodes 34, 36, 38 and 40 provide a slight forward voltage drop to block out the residual magnetizing force form transformer 42 and to thereby prevent false firing of triac 20. Everything between and including transformer 42 and its accompanying load resistor 52, and inductor 14 may be considered to be in "triac module" 15.

When triac 20 is conducting to form a complete bypass around element 14, a maximum amount of current flows through lamp 10. On the other hand, when triac 20 is not conducting then the minimum amount of current flows through lamp 10. By allowing triac 20 to conduct for part of the cycle, then the current through lamp 10, and hence the illumination therefrom, can be varied between the dim lamp current and full lamp current values. It is apparent, therefore, that merely controlling the period of conduction of triac 20 will achieve controllable illumination of lamp 10. A fuller explanation of the relationship of the phasing of the currents and voltages pertaining to the operation of the FIG. 1 circuit is given in U.S. Pat. No. 3,894,265.

Control of the conduction of triac 20 is accomplished by the controllable gate voltage means connected to transformer 42. To understand the operation of the control circuit, some additional phase relationships have to be appreciated. The voltage across element 14 (reactor voltage) is leading the lamp current by approximately 85° and also is leading the line voltage by approximately 30°.

In this prior art circuit, triac 20 should not be rendered conductive until current through and the voltage across element 14 are both of the same polarity, either both positive or both negative. If triac 20 was rendered conductive when the voltage across element 14 and the current therethrough were not of the same polarity, a phenomenon known as "half cycle conduction" would occur. The lamp would appear to flash from dim to full bright each half cycle and would produce an irritating strobing effect to the eye that would also be harmful to the lamp.

Power is applied to transformer 42 via the secondary 44 of power transformer 46 whose primary is connected across lines 16 and 18. One terminal of secondary 44 is connected to fuse or circuit breaker 48. Load resistors 50 and 52 connected to the two sides of the primary of transformer 42 are connected to ground. The power connection from the secondary 44 of transformer 46 to the primary of transformer 42 is through a bidirectional voltage regulating means in the form of cathode-to-cathode Zener diodes 54 and 56 and triac 58. It is well known that alternatively Zener diodes 54 and 56 may be connected anode-to-anode and operate in the same manner.

It is well known that the gate pulse to a triac controlling an inductive load is desirably a continuously applied gate voltage, rather than an instantaneous pulse. Again referring to FIG. 1, it may be seen that cathode-to-cathode Zener diodes 54 and 56 are connected in series with the main terminals of triac 58, the entire combination being connected as previously mentioned in series with secondary 44 of transformer 46. It is readily apparent that the gate voltage has for its source from secondary 44 a voltage which is in phase with the voltage across lines 16 and 18, a voltage which may be referred to as the "gate source voltage". It is, of course, in phase with the line voltage across lines 16 and 18.

Connected to the gate terminal of triac 58 is the cathode of programmable unijunction transistor 60. The gate connection to PUT 60 is connected to a rectified dc voltage via variable resistor 62. The timing of the conduction of PUT 60 is determined by the voltage differential between the voltage applied via resistor 62 and the voltage applied to the anode of PUT 60. Both the voltage applied to the anode and to the gate of PUT 60 are important to its conduction. The anode voltage must be slightly larger than the gate voltage to cause conduction. That is, conduction is dependent on the arithmetic difference between the voltage applied to the anode and gate. Therefore, the setting of resistor 62 "programs" what anode voltage is required to produce conduction. The dc voltage applied to resistor 62 is developed by bridge rectifier 64 connected to secondary 66 of transformer 46. A Zener diode 68 and current limiting resistor 70 insures that the voltage applied to resistor 62 never exceeds a predetermined value.

The output from bridge rectifier 64 is also connected through diode 72, fuse 73 and variable resistor 74 to a time constant control network connected to the anode of PUT 60. This time constant network includes capacitors 76 and 78 and resistor 80. A diode 82 is included in series with the voltage from resistor 74.

A diode 84 is the anode circuit of PUT 60 and capacitor 86 in the gate circuit of PUT 60 insure positive reset of PUT 60 following conduction. It should be noted that the operating adjustment for PUT 60 is determined by variable resistor 62. The ultimate control for determining the amount of brightness of lamp 10 is determined by the setting of resistor 74. As PUT 60 ages, the setting of resistor 62 can be changed, as well as permitting an easy setting for initial conditions.

In operation, programmable unijunction PUT 60 is turned on by the voltage difference between the voltage on the anode of PUT 60 (voltage on capacitor 78) and the voltage on the movable contact of resistor 62. On each cycle of ac voltage applied to the bridge, there is a rise to a dc level at the output of this bridge for application to the gate of PUT 60 through resistor 62. In a more sluggish fashion, a voltage determined by the setting of resistor 74 is applied to the anode of PUT 60. When the differential in these two voltages is reduced at the gate and anode of PUT 60 to the point of causing conduction, a gate voltage is supplied to triac 58. Triac 58 conducts when the secondary voltage of 44 applied thereto exceeds the Zener diode voltage of diodes 54 and 56. When diodes 54 and 56 conduct, there is a complete circuit in secondary winding 44 of transformer 46. This permits voltage to be supplied to transformer 42.

Yet another method of achieving the desired timing of PUT 60 to achieve firing within the desired gate range, even without Zener diodes 54 and 56, can be accomplished by selecting the components of resistor 74, resistor 75, which is connected between resistor 74 and ground, resistor 80, capacitor 78, the voltage determined by Zener diode 68, and the setting of the voltage on the gate of PUT 60 by the setting of the voltage on the gate of PUT 60 by the setting of the movable arm on resistor 62. The setting is determined by placing variable resistance 74 at its lowest or dim setting.

The operation of the part of the FIG. 1 circuit not in triac module 15 may be better understood by reference to the description of the circuit which is more fully set out in U.S. Pat. No. 3,894,265.

Now referring to FIG. 2, a triac module in accordance with the present invention is illustrated. In this embodiment, lamp 10 is connected in series with a ballast comprising inductive reactive portions 12 and 14. Reactive portion 14 is that portion which is partially bypassed in accordance with the above operation to obtain dimming, as previously described. Ac is applied to lamp 10 and the ballast via terminals 110 and 112, transformer primary 114 being connected across these terminals. Ballast reactive portion 12 is actually a secondary connected with respect to primary 114.

Gated bypass means in the form of gated triac 20 is connected across reactive portion 14 in the manner previously described. Also connected across reactive portion 14 is the snubber network comprising capacitor 32 and series resistor 30. Drive is provided by optically isolated driver means illustrated in FIG. 2 by commonly encapsulated light emitting diode 116 and light activated phototriac 118. This type of encapsulation of a light activated element and a light producing actuating element is often referred to as an "optocoupler". Phototriac 118 is connected to the gate connection of triac 20. Although the optionally isolated driver means is illustrated in FIG. 2 as including phototriac 118 as its driver portion, the driver portion can be a phototransistor 120, such as illustrated in FIG. 3, a photo-SCR, such as illustrated in FIG. 4, or other active element responding to light emissions, such as a photodiode or photo-FET. Generically, for purposes herein, such elements are sometimes referred to as "photodrive" elements.

It should be recognized that a photodiode, a phototransistor and a photo-FET are each non-latching type of photodrive elements and a photo-SCR and a phototriac are latching types. However, in the application of the present invention, either type is operable. For example, assuming the action of a non-latching type, the photodrive element is conductive only so long as the receiver L.E.D. is activated. Therefore, gate signal is applied to triac 20 only for the period of time the L.E.D. is conductive. But, because triac 20 is a latching type of semiconductor, it remains conductive until there is natural commutation of the current therethrough.

Figure 14:
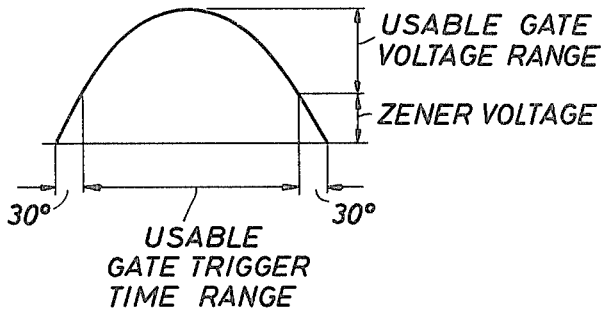
FIG. 14 is a graphic timing diagram of the voltage, resulting from the operation of the circuit shown in FIG. 13.

For a latching type of photodrive element, the photodrive element itself is conductive until there is natural commutation thereof. This natural commutation occurs before the natural commutation of triac 20 because of the Zener diodes assuring operation only within the usable gate trigger time range, as shown in FIG. 14. Hence, there would be gate signal supplied for a longer period of time to phototriac 20 than with the nonlatching type of photodrive element. But, because triac 20 is a latching type of semiconductor, its operation is not different because of the type of drive element connected to its gate.

Since current flows through a transistor or an SCR primarily in one direction, and assuming the application of a conventional ac signal, the gate signal is applied on alternate half cycles in the embodiment shown in FIG. 2, which is sufficient for triac 20 to respond to both cycles of the ac applied across its main terminals. When a phototriac is used as the driver portion, the gate signal is applied on every half cycle. It should be apparent that an inversion network working with one phototransistor or photo-SCR connected in parallel with a second phototransistor or photo-SCR would produce every half-cycle gating, if desired. Likewise, a bridge could be employed with a phototransistor or photo-SCR to produce every half-cycle gating, if desired.

Phototriac 118 has one of its main terminals connected to the gate of triac 20 and its other terminal connected to resistor 122. Low voltage is supplied to resistor 122 via a low voltage tap 124 of transformer winding 114 to which a gate resistor 126 is connected for voltage division. Filter capacitor 128 is connected to the junction of resistors 122 and 126 and to a return low voltage tap 130 of transformer winding 114, the same connection point for the return side of ballast reactive portion 14. The filter prevents unwanted high frequencies from being applied to optically isolated triac driver 118.

The leads of diode 116 in the optocoupler are connected to receive applied unidirectional pulses through current limiting series resistor 117. This resistor may appear in either lead and is understood to be present in all of the embodiments illustrated herein, not just the embodiment illustrated in FIG. 2. It will be appreciated that the duration of the application of the pulses applied to diode 116 determines the length of time that light is emitted from diode 116 and hence the conduction time for phototriac 118. That is, when pulses are applied to diode 116, phototriac 118 conducts. When pulses are not applied to diode 116, phototriac 118 remains non-conductive. For a phototriac to operate in this manner, since it is a latching type of photodrive element, it is necessary to include a Zener diode 121 in series therewith so that when it once becomes conductive it will not remain in that state when the gating pulses to diode 116 are removed. However, alternate photodrive elements such as a phototransistor, photo-diode and a photo-FET operate in a similar manner without such a Zener diode since they are non-latching elements. A Zener diode 121 should be included in all of the embodiments illustrated herein when the photodrive element is of the latching type.

The longer the conduction time for phototriac 118, the longer the applied trigger to the gate of triac 20, and, hence, the longer the period of current bypass of reactive portion 14 over a given time period. It should be noted that the pulsing of diode 116 can be quite independent of the current cycle of the ac distribution line, as hereafter more fully set forth.

FIG. 4 shows voltage to a photo-SCR 240 being taken from transformer 114, as in the case of the circuit shown in FIG. 2. However taps 241 and 243 above and below center tap 242, which may typically be 18-volt taps, provide connection points to diodes 245 and 247, respectively. The cathodes of these two diodes are connected together and to current limiting resistor 249 connected to the photo-SCR. The output of the photo-SCR is connected to Zener diode 121 and then to the gate of triac 20. Resistor 251 provides suppression of leakage currents. Diodes 245 and 247 provide full wave rectification to establish a pulse each half cycle through photo-SCR 240, and hence, each half cycle there is a gate signal applied to triac 20. This same mode of operation is also applicable for operating a phototransistor or a photo-FET. Alternatively to diodes 245 and 247, the same type of pulsing can be provided by a low voltage transformer connected to a full-wave rectifying bridge.

Now referring to FIG. 5, alternate triac module is illustrated. As with the embodiment shown in FIG. 2, lamp 10 is connected in series with a ballast comprising an inductive reactive portion 12, which is not bypassed in operation, and an inductive reactive portion 14, which is bypassed in operation. Gated triac 20 is again connected with its main terminals across portion 14 and the snubber network comprising capacitor 32 and series resistor 30 is connected across the main terminals of triac 20. Encapsulated phototriac 118, forming a driver portion, and light emitting diode 116, forming a receive portion for external trigger operation are connected so that phototriac 118 is connected to drive the gate of triac 20 and diode 116 is connected to receive the external pulsing.

A low voltage tap on reactive portion 12 is connected to resistor 31 which, in turn, is connected to series resistor 33. Resistor 33 is connected to phototriac 118. Capacitor 35 is connected between the junction of resistor 31 and resistor 33 and the junction between reactive portions 12 and 14 to form a storage element whose charge is used to drive the gate of triac 20 when phototriac 118 is rendered conductive. This tends to assure phase insensitivity. Operationally the circuit operation is the same as described above with respect to FIG. 2 except that the low voltage ac tap on reactive element 12 provides the drive current for phototriac 118. As is illustrated by dash line 13 in FIG. 5, the connection to resistor 31 may be made directly to lamp 10, rather than to a tap of reactive portion 12.

Now referring to FIG. 6 an alternate circuit to that shown in FIG. 5 is illustrated. In this case all particulars are the same except for the ballast properties. Instead of two series-connected inductive components, there is a loosely coupled ballast transformer 15. The primary winding of ballast transformer 15 is connected in series with lamp 10 and the ac input is applied to the series combination of lamp 10 and the primary winding. The secondary winding of ballast transformer 15 is connected to the primary winding at the end thereof not connected to lamp 10. Triac 20 is connected across this secondary winding. A low voltage tap of the primary winding is connected to resistor 31.

Operationally, the circuit is identical to the circuit illustrated in FIG. 5. That is, two series-connected inductive elements, such as shown in FIG. 5, are equivalent to a loosely coupled ballast transformer connected in the manner illustrated in FIG. 6. It should be further apparent that two inductive elements not loosely coupled, but connected in the manner of the ballast transformer windings shown in FIG. 6, would functionally operate in similar fashion. Further, although the equivalent operation is discussed with respect to the circuits of FIGS. 6 and 5, it should be apparent that the loosely coupled ballast transformer connection and the parallel inductive element connection would be equivalent to the series-connected inductive elements shown in all of the embodiments illustrated herein, the series connection being illustrated merely out of convenience and not by way of limitation.

Figure 7:
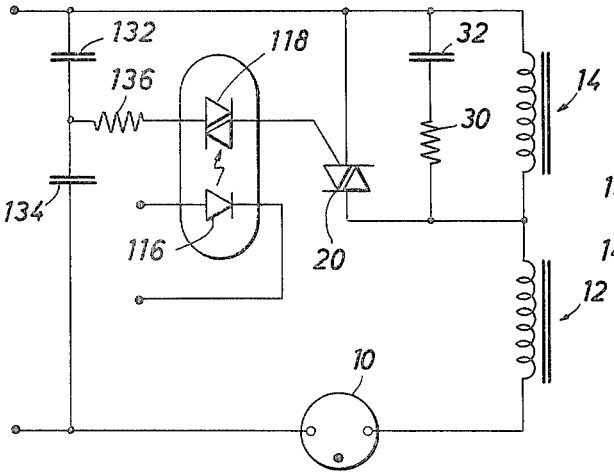
FIG. 7 is a schematic diagram of an embodiment of the present invention employing a capacitor divider network for supplying low voltage to the driver portion of an optocoupler.

FIG. 7 illustrates an alternate embodiment for connection of a dimmer circuit including an optocoupler to an ac distribution line. In this case there is no transformer connection to the ac distribution line, as with FIG. 2, but instead there is a capacitor divider network comprising capacitor 132 and 134. The low power, low voltage drive voltage across capacitor 132 applied to phototriac 118 is supplied via gate resistor 136. Also, since there is no transformer, either reactive portion 12 nor portion 14 is a secondary to any transformer. In this embodiment, ac is applied across the series combination of portions 12 and 14 and lamp 10. Operation is identical to that described for FIG. 2.

Figure 8:
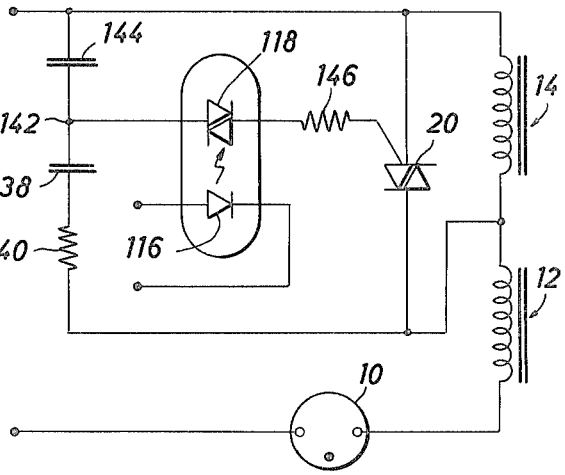
FIG. 8 is a schematic diagram of an embodiment of the present invention employing a capacitor divider network in combination with a snubber capacitor for supplying low voltage to the driver portion of an optocoupler.

FIG. 8 illustrates an embodiment of a triac module similar to the above; however, this embodiment employs the capacitor in the snubber as one portion of the capacitor divider network. In this case, the snubber combination of capacitor 138 and resistor 140 is connected between one main terminal of triac 20 and voltage input point 142 to phototriac 118. Point 142 is connected to capacitor 144, the other portion of the capacitor divider, which is connected to the ac distribution line, to provide low power, low voltage across capacitor 144. Gate resistor 146 is in the lead connecting the voltage input point to the gate of triac 20, in this case between phototriac 118 and triac 20.

The circuit of FIG. 8 operates a little differently from the circuits of FIG. 2 and 7 in that each cycle of ac applied there must be a little off time of triac 20 to permit the development or build-up of a voltage across the snubber combination, particularly capacitor 138.

Figure 9:
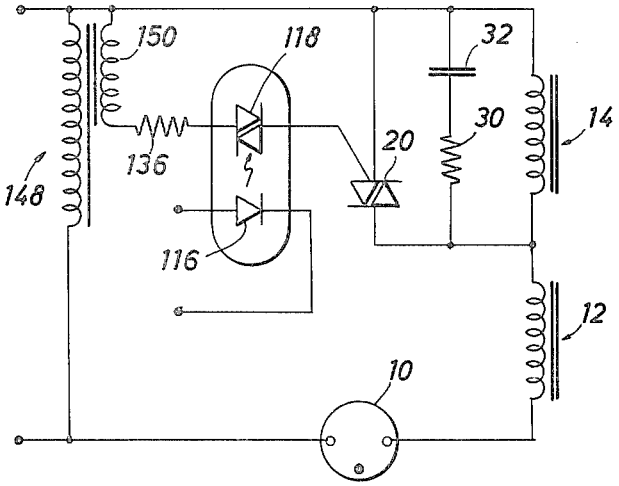
FIG. 9 is a schematic diagram of an embodiment of the present invention employing a low voltage transformer for supplying low voltage to the driver portion of an optocoupler.

FIG. 9 illustrates an embodiment very similar to FIG. 2, but transformer action does not enter into applying ac to reactive portions 12 and 14 and lamp 10. There is a transformer 148 across the ac distribution line having a secondary winding 150 for developing low voltage for application to gate resistor 136 and phototriac 118.

Figure 10:
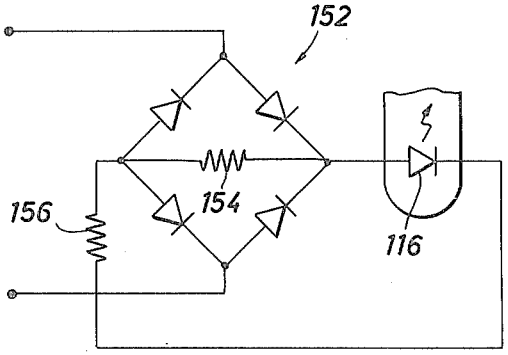
FIG. 10 is a partial schematic diagram of a bridge-type network that is connectable to the receiver portion of an optocoupler for converting bipolar pulses to suitable unipolar pulses for operating purposes.

FIG. 10 illustrates a network addition that may be connected to light emitting diode 116 for pulse shaping purposes. It has been previously assumed that the pulses applied to diode 116 have been basically unipolar or unidirectional. That is, when the pulses are applied to receiver diode 116 so as to cause conduction, the power driver portion is turned on. If the applied pulses are bipolar or bidirectional, then diode 116 is only turned on when there are pulses of the polarity that cause conduction of diode 116. Bridge 152, typically comprising a ring of four diodes, the input to the bridge being connected across one pair of opposite corners and the output being across the other pair of opposite corners, is connected to convert the bipolar signal to a unipolar signal. Resistor 156 in series with diode 116 provides current limiting for application of the pulses to diode 116. Resistor 154 is not necessary in many applications and is provided primarily for leakage compensation purposes, as is well known in the art.

Figure 11:
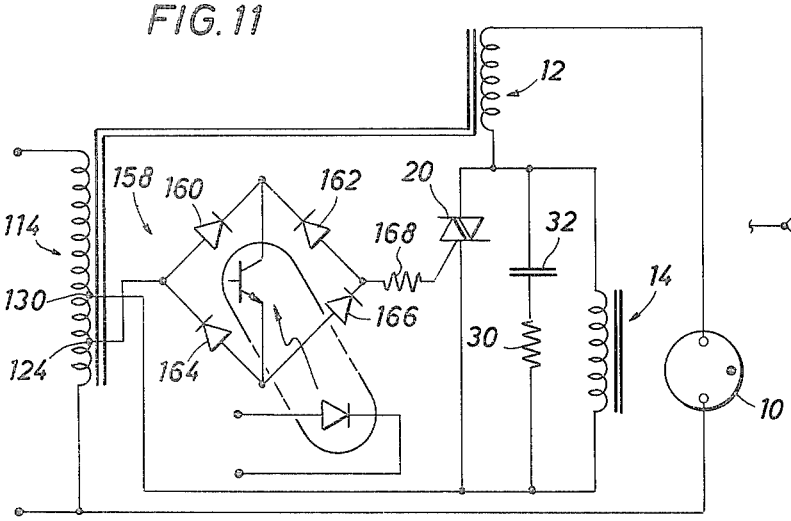
FIG. 11 is a schematic diagram of an embodiment of the present invention employing a phototransistor in the optocoupler and a suitable "bridge" connected thereto for uniform operation on both polarities of the applied low voltage ac.

FIG. 11 illustrates an embodiment similar to FIG. 1, but including an alternate network including the driver portion of the optocoupler. In this circuit, like in FIG. 2, there is a ballast transformer primary 114 across the incoming ac distribution line and having a normal ballast tap 130 connected to reactive portion 14 and tap 124 connected to a "bridge" 158 connected to the driver portion of the optocoupler. In this case, the driver portion is assumed to be a phototransistor, which conducts more easily in one direction than the other. The input and output of bridge 158 are connected so that a pair of cathode-to-cathode diodes 160 and 162 block conduction along one path and a pair of anode-to-anode diodes 164 and 166 block conduction along another path. Positive half cycles applied from tap 124 cause conduction through the phototransistor to cause diodes 160 and 166 to conduct. Similarly, negative half cycles applied from tap 124 cause conduction through diodes 162 and 164 and the phototransistor. The resulting continuous signals are applied via gate resistor 168 to the gate of triac 20.

Figure 12:
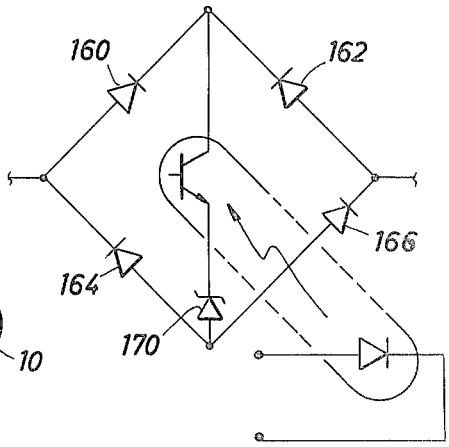
FIG. 12 is a partial schematic diagram of an embodiment of the present invention employing a Zener diode in series with the drive portion of the optocoupler for ensuring only voltage above a predetermined level is applied as drive voltage, and hence to provide timing assurance of operation of the gated bypass means.

FIG. 12 includes a Zener diode 170 in series with the phototransistor of the embodiment shown in FIG. 11 so that only voltages beyond a certain or predetermined value cause conduction of triac 20, thereby providing means for developing finer control of gating on triac 20. Otherwise, the operation of the circuit is identical to that shown in FIG. 11.

It should be further noted that the bridge connection shown in FIG. 10 connected with respect to receiver diode 116 and the bridge connection shown in FIGS. 11–12 connected with respect to the photodriver element can both be used in the same circuit.

Throughout the discussion of the circuits shown in FIGS. 2–12, the ac line voltage connected to provide power for the lamp is also the voltage used to derive the current through the photodriver of the optocoupler and, hence, the current for gating the gated bypass means. Therefore, the pulsing of light emitting diode 116 may be quite independent of the cycles occurring in the ac distribution line so long as it is within allowed operating time limits (as is shown in FIG. 14). Hence, the bypassing action of winding 14 is not independent of the current applied to the lamp. Moreover, the current applied to the lamp is controllable in the same manner shown and described with respect to FIGS. 2, 2,*a*, 2*b* and 3 of U.S. Pat. No. 3,894,265.

Figure 13:
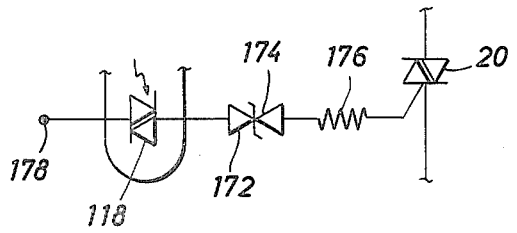
FIG. 13 is a partial schematic diagram of oppositely poled Zener diodes in series with phototriac drive means for timing assurance of applied voltage to the gated bypass means.

When the input or gating pulses applied to receiver diode 116 of the optocoupler are applied only within the usable gate trigger time range as shown in FIG. 14, when Zener diodes 172 and 174 are not needed. However, to ensure that the gate signal to gated triac 20 in FIGS. 2–12 is not advanced or delayed too much, it is possible to include two Zener diodes, such as Zener diodes 172 and 174 in FIG. 13, in series with the gate of the triac. In FIG. 13, there Zener diodes are shown connected cathode-to-cathode, although anode-to-anode connection therefor is equally appropriate. Series resistor 176 limits the gate current and terminal 178 is the application point for the applied low voltage. FIG. 14 shows the usable gate voltage range established to be approximately 60° less than the total half cycle of the applied voltage, the usable range being in the center of the applied voltage range. The range is determined as described in U.S. Pat. No. 3,894,265. A diode bridge similar to that shown in FIG. 12 having a single Zener diode can be used in place of the two Zener diodes shown.

Figure 15:
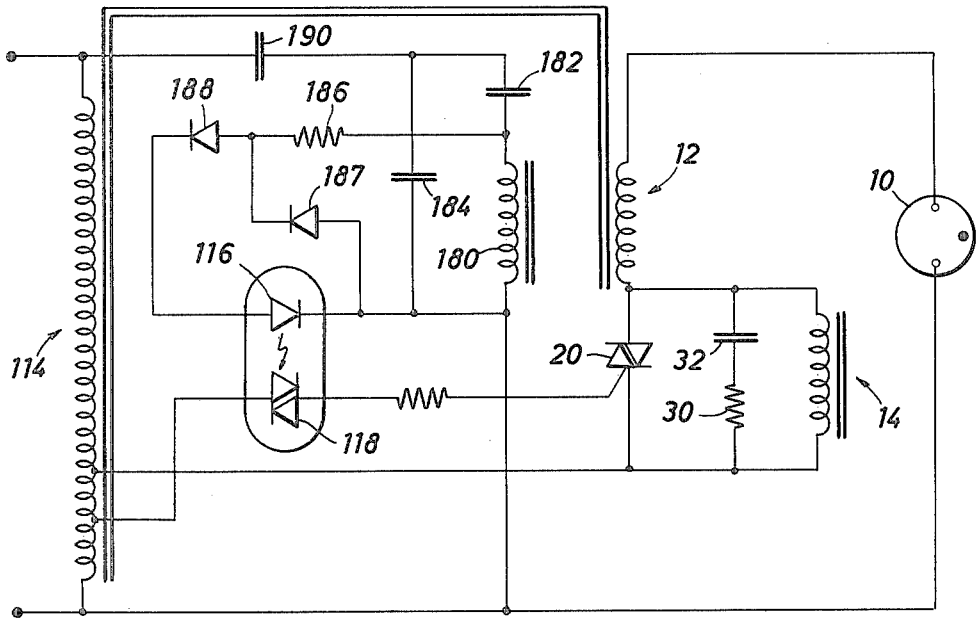
FIG. 15 is a schematic diagram of an embodiment of the present invention employing a time network connected to the receiver portion of the optocoupler to permit operation in conjunction with a high frequency signal superimposed on the ac distribution line or by way of separate gate leads.

FIG. 15 illustrates a circuit which is operable with respect to applied pulses to the receiver diode of the optocoupler at high frequencies. In this embodiment, the optocoupler triac is connected to a low voltage tap of transformer winding 114 and winding 14 is connected to the normal ballast tap thereof in the manner shown for FIG. 2. However, the light emitting diode of the optocoupler is connected to a resonant timed network comprising coil 180 in series with capacitor 182, all of which is in parallel with capacitor 184. The junction coil 180 and capacitor 182 is connected to current limiting resistor 186 and diode 188, which returns for connection to LED 116. Power is supplied through high voltage coupling capacitor 190 to the high side of the incoming ac distribution line. The connection from the cathode of diode 116 to the low or common side of the incoming ac distribution line completes the operating connection. The anode of diode 187 is connected to the cathode of diode 116 and the cathode of diode 187 is connected to the junction between resistor 186 and diode 188 to bleed off high voltages that would otherwise build up on capacitor 184.

High frequency input to the LED of the optocoupler is superimposed onto the ac distribution line in bursts or spurts performing much the same function as the pulses applied directly to the LED shown in other embodiments. The high frequency signals are detected by the timed resonant circuit to produce an envelope signal which is rectified into suitable unipolar pulses for application to the LED. Stray high frequency signals not of the predetermined high frequency for which the circuit is tuned is filtered out and does not produce a pulse for activating diode 116.

Figure 16:
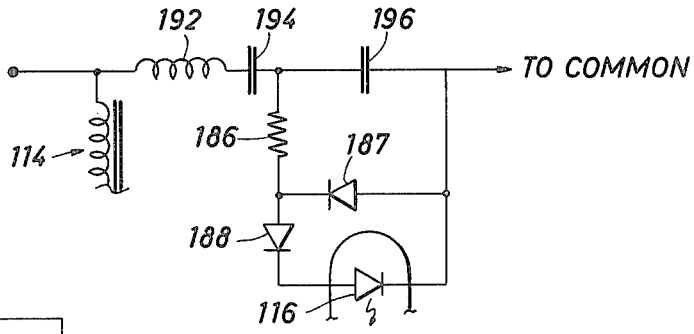
FIG. 16 is a schematic diagram of an alternate embodiment to that shown in FIG. 15.

FIG. 16 illustrates a series tuned resonant circuit comprising coil 192, capacitor 194 and capacitor 196, the connection to resistor 186 and diode 188 being taken from between the capacitors. Diode 187 is connected from diode 116 to the junction between resistor 186 and diode 188. Operationally, the circuit functions in a similar fashion to the circuit of FIG. 15.

Figure 17:
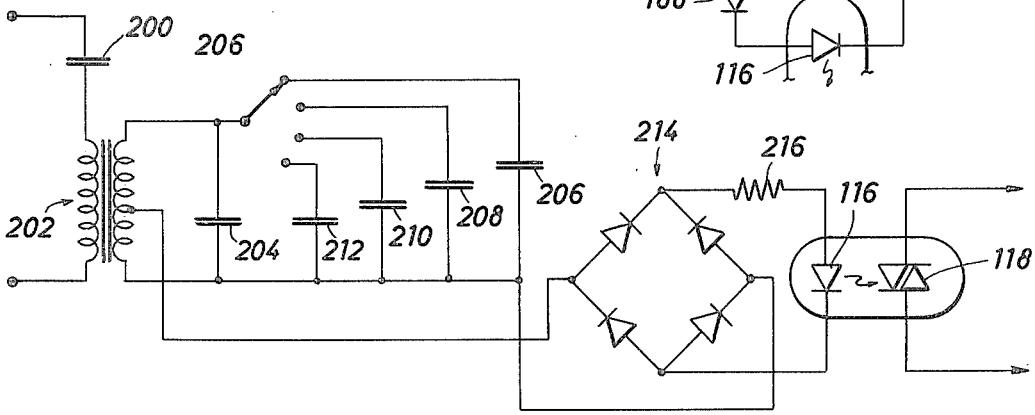
FIG. 17 is a schematic diagram of an embodiment of the present invention employing a switch for selecting among a plurality of components to change the response frequency of a timed network connected to the receiver portion of the optocoupler, thereby permitting operation in conjunction with one of a plurality of possible selectable high frequency signals superimposed on the ac distribution line or supplied by separate gate leads.

FIG. 17 shows a further embodiment of a tuned circuit operating in conjunction with an optocoupler dimmer. In this embodiment, ac line voltage is applied through coupling capacitor 200 through transformer 202, the secondary of which is tuned by a capacitor 204 connected across its secondary. A switch 206 is connectable to one of capacitors 208, 210, 212 and 214 such that when one of these capacitors is connected by the switch, the entire timed combination is tuned to the selected frequency determined by the switched-in capacitor. The output of the tuned circuit and a low voltage tap is connected to a bridge, which, in turn, is connected to a pulse shaping bridge 214 connected to LED 116 of the optocoupler via load resistor 216.

In operation of FIG. 17 circuit, a dimmer circuit operating in conjunction with a first lamp can be tuned to a selected first frequency by placing switch 206 to a first position, a dimmer circuit operating in conjunction with a second lamp can be tuned to a selected second frequency by placing switch 206 to a second position, and so forth. High frequency signals superimposed on the ac distribution line can then be used for selected dimming purposes. That, is a half-cycle signal of first frequency would be detected so as to cause dimming of the first lamp, but would not have an operating effect on the second lamp. Likewise, a signal of the second frequency would operate the second lamp circuit, but not the first. If it was desired to dim the first and second lamps, both frequencies could be superimposed. Of course, different dimming could also be achieved by having different frequencies for the spurts of signal at a first high frequency and the spurts or bursts of signal at a second high frequency. Additional lamp circuits could be similarly programmed selectively for dimming operations, as desired. Finally, two lamps could be identically operated, if desired, by identically setting their dimming control components as above described.

Although one method of tuning the tunned circuit has been shown in FIG. 17, there are many other ways of doing this well within the skill of persons in the art.

While particular embodiments of the invention have been shown and described, it will be understood that the invention is not limited thereto, since many modifications may be made and will become apparent to those skilled in the art. For example, the tuned circuit connections of FIGS. 15–17 have been described as being connected to the ac distribution line to receive high frequency bursts superimposed thereon. There is an economy of wiring through this type of connection since it minimized the number of connecting leads to the circuit; however, it should be understood that high frequency signalling can be separately applied to the receiver portion of the optocoupler and does not have to be applied superimposed on the ac distribution line.

Furthermore, the embodiments show at least partial cycle low voltage ac applied through the driver portion of the optocoupler for gating the main triac 20. Any suitable gate signal for gating triac 20 can be employed if operational with respect to the driver portion of the optocoupler. For example, pulsed dc operates quite well through a photo-SCR. Even flat dc is satisfactory with a phototransistor or a photo-FET.

If it is desirable to convert conventional ac to a pulsed-dc type signal for gating on triac 20 at all times, either a bridge circuit can be used in conjunction with the connection to the photodrive element of the optocoupler or two optocouplers can be used poled for operation on the alternate half cycles. Full cycle ac or continuous dc applied to receiver diode 116 of the optocoupler causes continuous bypass operation and hence full bright lighting conditions.

What is claimed is:

1. In combination with a high intensity gaseous discharge lamp, a dimmer circuit for controlling the brightness thereof, comprising:

ballast means connected to the lamp and connectable to receive power from an ac distribution line, said ballast means including a reactive portion, gated bypass means for providing at least partial bypass of current around said reactive portion of said ballast, optically isolated driver means connected to said gated bypass means, said optically isolated driver means including a driver portion connected to receive low voltage for gating said gated bypass means, and a receiver portion connected to receive externally applied pulses and for optically switching on said driver portion in the presence of such pulses.

2. The dimmer circuit in accordance with claim 1, wherein said driver portion includes a non-latching photodriver which becomes non-conductive in the absence of pulses applied to said receiver portion.

3. The dimmer circuit in accordance with claim 1, wherein said low gating voltage connected to said driver portion of said optically isolated driver means is at least a partial ac voltage in phase with the ac from the ac distribution line.

4. The dimmer circuit in accordance with claim 1, wherein said low gating voltage is pulsed dc.

5. The dimmer circuit in accordance with claim 1, and including a voltage transformer connected to the ac distribution line, and wherein said driver portion of said optically isolated driver means is connected to a low voltage tap of said voltage transformer.

6. The dimmer circuit in accordance with claim 1, wherein said ballast means includes a non-bypassed reactive portion, said driver portion of said optically isolated driver means being operatively connected to said non-bypassed reactive portion.

7. The dimmer circuit in accordance with claim 6, wherein said optically isolated driver means is connected to a low voltage tap of said non-bypassed reactive portion.

8. The dimmer circuit in accordance with claim 6, wherein said non-bypassed reactive portion is connected to the lamp and wherein said optically isolated driver means is connected to said non-bypassed reactive portion at its connection to the lamp.

9. The dimmer circuit in accordance with claim 1, wherein said ballast means includes a loosely coupled ballast transformer.

10. The dimmer circuit in accordance with claim 9, wherein said driver portion of said optically isolated driver means is connected to a low voltage tap of said ballast transformer primary.

11. The dimmer circuit in accordance with claim 1, and including a voltage transformer connected to the ac distribution line, and wherein said driver portion of said optically isolated driver means is connected to a secondary of said voltage transformer.

12. The dimmer circuit in accordance with claim 1, wherein said ballast means includes a secondary winding of a transformer, and wherein the primary of said transformer is connected to said driver portion of said optically isolated driver means and to the lamp.

13. The dimmer circuit in accordance with claim 1, wherein said gated bypass means includes a gated triac.

14. The dimmer circuit in accordance with claim 1, wherein said driver portion of said optically isolated driver means includes a phototriac.

15. The dimmer circuit in accordance with claim 1, wherein said driver portion of said optically isolated driver means includes a phototransistor.

16. The dimmer circuit in accordance with claim 1, wherein said driver portion of said optically isolated driver means includes a photo-SCR.

17. The dimmer circuit in accordance with claim 1, wherein said driver portion of said optically isolated driver means includes a photo-FET.

18. The dimmer circuit in accordance with claim 1, wherein the applied pulses are polarity unidirectional and wherein said receiver portion of said optically isolated driver means includes a light emitting diode.

19. The dimmer circuit in accordance with claim 1, and including a capacitor divider network connected to the ac distribution line, and wherein said driver portion of said optically isolated driver means is connected to the junction of said capacitor divider network to provide the low ac voltage.

20. The dimmer circuit in accordance with claim 1, and including a snubber around said gated bypass means.

21. The dimmer circuit in accordance with claim 20, wherein said snubber includes a capacitor.

22. The dimmer circuit in accordance with claim 20, and including another capacitor, said another capacitor and said first-named capacitor forming a capacitor divider network connected to the ac distribution line, and wherein said driver portion of said optically isolated driver means is connected to the junction of said capacitor divider network to provide the low ac voltage.

23. The dimmer circuit in accordance with claim 1, wherein said receiver portion of said optically isolated driver means includes an ac-to-dc converter for converting received bipolar pulses to unipolar pulses.

24. The dimmer circuit in accordance with claim 23, wherein said ac-to-dc converter includes a bridge.

25. The dimmer circuit in accordance with claim 1, wherein said optically isolated driver means includes a bidirectional driver portion for ensuring operation of applied ac on both positive and negative half cycles thereof.

26. The dimmer circuit in accordance with claim 1, wherein said optically isolated driver means includes a unidirectional driver portion and a low voltage bridge connected across said driver portion for ensuring operation of applied ac on both positive and negative half cycles thereof.

27. The dimmer circuit is accordance with claim 26, and including a Zener diode in series with said driver portion of said optically isolated driver for ensuring only ac above a predetermined level is applied to said gated bypass means.

28. The dimmer circuit in accordance with claim 1, and including two Zener diodes connected in series oppositely poled and in series with said driver portion for ensuring operation of said gated bypass means only when the low voltage ac is within a predetermined time range of the ac applied to said ballast means.

29. The dimmer circuit in accordance with claim 1, wherein said receiver portion of said optically isolated driver means includes a tuned circuit, pulses applied thereto at the frequency to which the tuned circuit is tuned optically switching on said driver portion.

30. The dimmer circuit in accordance with claim 29, wherein said tuned circuit is parallel tuned.

31. The dimmer circuit in accordance with claim 29, wherein said tuned circuit is series tuned.

32. The dimmer circuit in accordance with claim 29, and including a diode for ensuring that only applied pulses of one polarity switch on said driver portion.

33. The dimmer circuit in accordance with claim 29, and including means for selectively tuning said tuned circuit for different frequencies.

34. The dimmer circuit in accordance with claim 33, wherein said selectively tuning means includes a plurality of capacitors and switch for selectively connecting from said capacitors for changing the tuning of said tuned circuits.

* * * * *